US006009584A

United States Patent [19]

Padden

[11] Patent Number: 6,009,584

[45] Date of Patent: Jan. 4, 2000

[54] MULTI-PURPOSE TOOL WITH BRUSH

[76] Inventor: Stephen J. Padden, 1303 Cypress Point Ln. Apt. 204, Ventura, Calif. 93003

[21] Appl. No.: 08/979,136

[22] Filed: Nov. 26, 1997

[51] Int. Cl.[7] ..... B25F 1/00; A46B 29/17

[52] U.S. Cl. ..... 7/170; 15/201

[58] Field of Search ..... 7/114, 138, 169, 7/170; D8/105; 15/105, 184, 201

[56] References Cited

U.S. PATENT DOCUMENTS

| | | | |
|---|---|---|---|
| D. 101,073 | 9/1936 | Tamis . | |
| D. 172,108 | 5/1954 | Polincovsky . | |
| D. 288,898 | 3/1987 | Osterhout . | |
| D. 348,500 | 7/1994 | Mortenson et al. | D21/234 |
| D. 374,388 | 10/1996 | Padden . | |
| D. 384,974 | 10/1997 | Sawano | D19/65 |
| 464,405 | 12/1891 | Widmann . | |
| 973,930 | 10/1910 | Fink . | |
| 1,590,492 | 6/1926 | Benson . | |
| 2,408,888 | 10/1946 | Shoop . | |
| 2,412,056 | 12/1946 | Mosch . | |
| 2,630,212 | 3/1953 | Mosch . | |
| 3,409,347 | 11/1968 | Vogel . | |
| 3,797,055 | 3/1974 | Greene | 7/1 G |
| 3,958,690 | 5/1976 | Gee, Sr. . | |
| 4,037,716 | 7/1977 | Marks . | |
| 4,202,445 | 5/1980 | Porter . | |
| 4,300,610 | 11/1981 | China . | |
| 4,331,194 | 5/1982 | Lederer . | |
| 4,457,425 | 7/1984 | Cooper et al. . | |
| 4,535,987 | 8/1985 | Dikoff | 273/32 |
| 4,734,953 | 4/1988 | Dodson | 15/106 |
| 4,934,528 | 6/1990 | Miller et al. . | |
| 4,946,030 | 8/1990 | Guridi et al. . | |
| 4,974,842 | 12/1990 | Widman | 273/32 |
| 5,080,223 | 1/1992 | Mitsuyama . | |
| 5,328,026 | 7/1994 | Newman . | |
| 5,333,343 | 8/1994 | Nichols et al. | 15/106 |
| 5,467,871 | 11/1995 | DeField | 206/232 |
| 5,617,605 | 4/1997 | Hoerner et al. | 15/15 |

*Primary Examiner*—David A. Scherbel
*Assistant Examiner*—Philip J. Hoffmann
*Attorney, Agent, or Firm*—Kenneth J. Hovet

[57] ABSTRACT

A thin card-like housing that incorporates a retractable brush and other useful implements. The brush has a base with an outer edge from which bristles extend. The base includes a deflectable web portion having a rib extending through an actuation opening in the housing. Manual engagement of the rib is used to move the brush from an outwardly extended operative position to a retracted storage position within the housing. The web portion includes wedge parts that releasably engage detent structures inside the housing. The detent structures are positioned to correspond to the storage and operative positions of the brush. The housing interior also includes guide posts that extend through guide openings in the brush base to facilitate brush alignment and movement.

29 Claims, 6 Drawing Sheets

MULTI-PURPOSE TOOL WITH BRUSH

BACKGROUND OF THE INVENTION

1. Field of the Invention

The present invention concerns manual tools and, more particularly, a compact multi-purpose tool that includes a retractable brush.

2. Description of Related Art

The most common types of multi-purpose tools have evolved from pocket knives. In addition to knife blades, pocket knives have been adapted to include a variety of miniaturized implements such as files, awls, screwdrivers, bottle and can openers and even scissors. To accommodate the additional implements, longer, wider and stronger knife casings are used. Today, even the most streamlined multi-purpose pocket tools have become heavy and bulky. In fact, due to their bulk, such tools are oftentimes provided with their own holsters.

To overcome the above disadvantages, a card-like housing was developed for holding a variety of thin implements. This housing is shown in U.S. Pat. No. 5,328,026. Construction of the above housing, however, involves the lamination of a middle layer having cut-out areas between two outer layers. The cut-out areas correspond to the outline of implements to be contained within the housing. This construction created unnecessary material costs added unnecessary assembly and molding steps.

Other examples for enclosing miniaturized implements in thin housings are shown in U.S. Pat. Nos. D101,073, D172,108, D288,898, 464,405, 973,930, 1,590,492, 2,412,056 and 2,630,212. The patented devices shown in the above patents most often utilize hinges, clasping mechanisms, pivot arms, levers and spring means. As a result, they are not convenient to carry as a personal item and they are oftentimes difficult to use.

SUMMARY OF THE INVENTION

The present invention provides a thin compact housing that is lightweight, easy to construct and uniquely accommodates a wide variety of implements. In particular, the subject housing incorporates a retractable brush and may include other specified items relative to the intended field of use. The specific items described in this invention have particular applicability to the sport of golf.

The above-mentioned brush comprises a generally flat elongated base having bristles that extend about parallel with the plane of the base. The brush is mounted within the housing interior and moves from a retracted position within the interior to an operative position whereby at least the bristles extend outside the interior.

The base of the brush includes an actuation means comprising a deflectable web portion having a rib that extends into a housing actuation opening. The actuation opening allows a user to access the rib and move the brush to the desired positions.

The web portion of the brush is provided with a holding means comprising at least one wedge part that engages a corresponding detent structure in the housing interior. The detent structure is located to releasably hold the brush in the aforementioned retracted and operative positions.

The housing interior may also include constraining means to help guide the brush during its movement and prevent complete separation from the housing. This comprises at least one guide post extending from a sidewall into an elongated guide opening in the brush base.

The housing periphery may include a tool opening in communication with the interior. This opening permits the insertion of a golf divot tool, knife or other elongated implement into the interior.

The housing periphery may further include a recess. The recess is defined by opposing arcuate edges that provide releasable engagement with disc-shaped objects such as golf ball markers.

Additionally, a portion of the housing periphery may be inset. The inset periphery corresponds to the shape of a writing instrument and provides a streamlined location for releasable engagement with the instrument.

DESCRIPTION OF THE PREFERRED EMBODIMENTS

Figure 1:
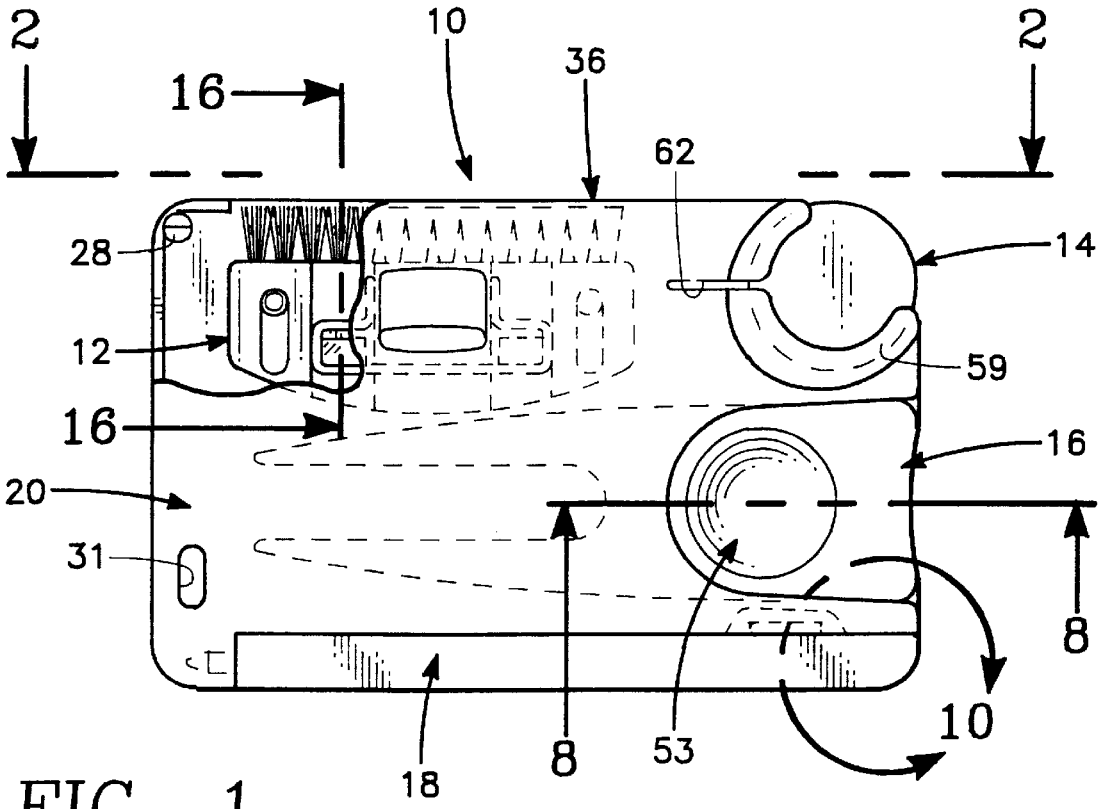
FIG. 1 is a front elevational view of the assembled tool of the invention with a partial cut-away showing the brush in a retracted position.
Figure 2:
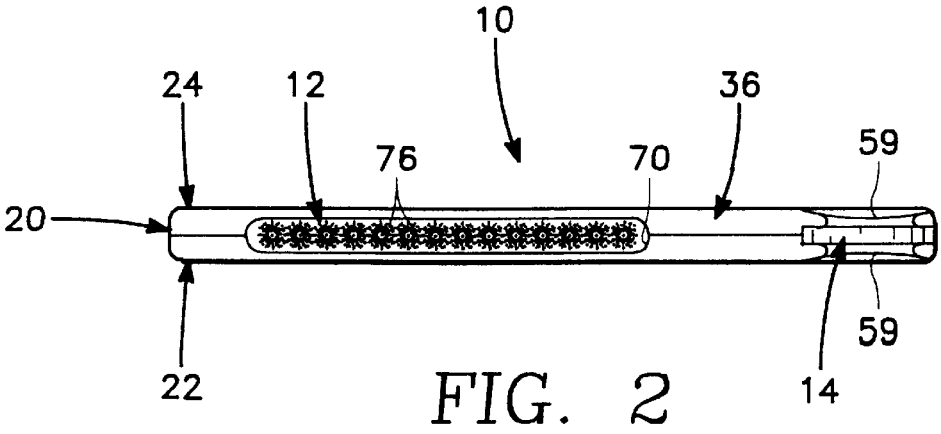
FIG. 2 is a top plan view taken along lines 2—2 of FIG. 1.
Figure 3:
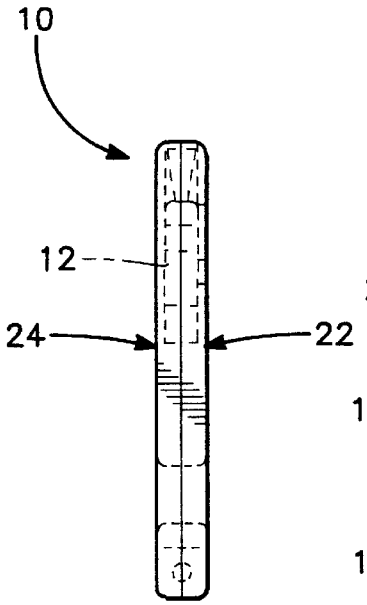
FIG. 3 is a left side elevational view of the tool shown in FIG. 1.
Figure 4:
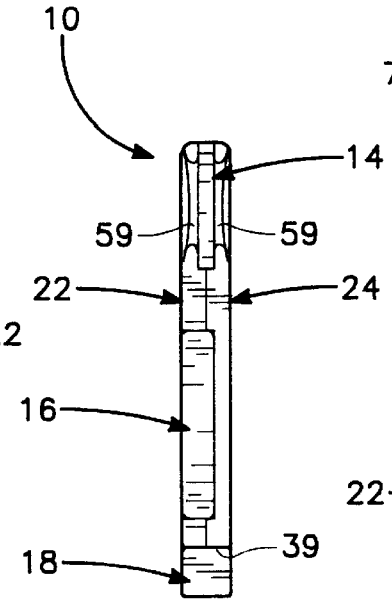
FIG. 4 is a right side elevational view of the tool shown in FIG. 1.
Figure 6:
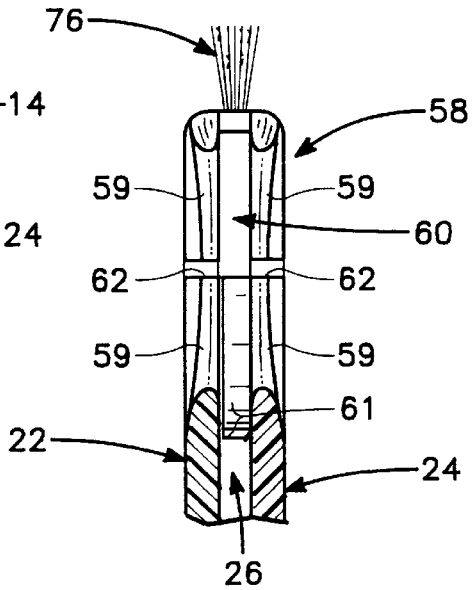
FIG. 6 is an enlarged cross-sectional view taken along lines 6—6 of FIG. 5.
Figure 5:
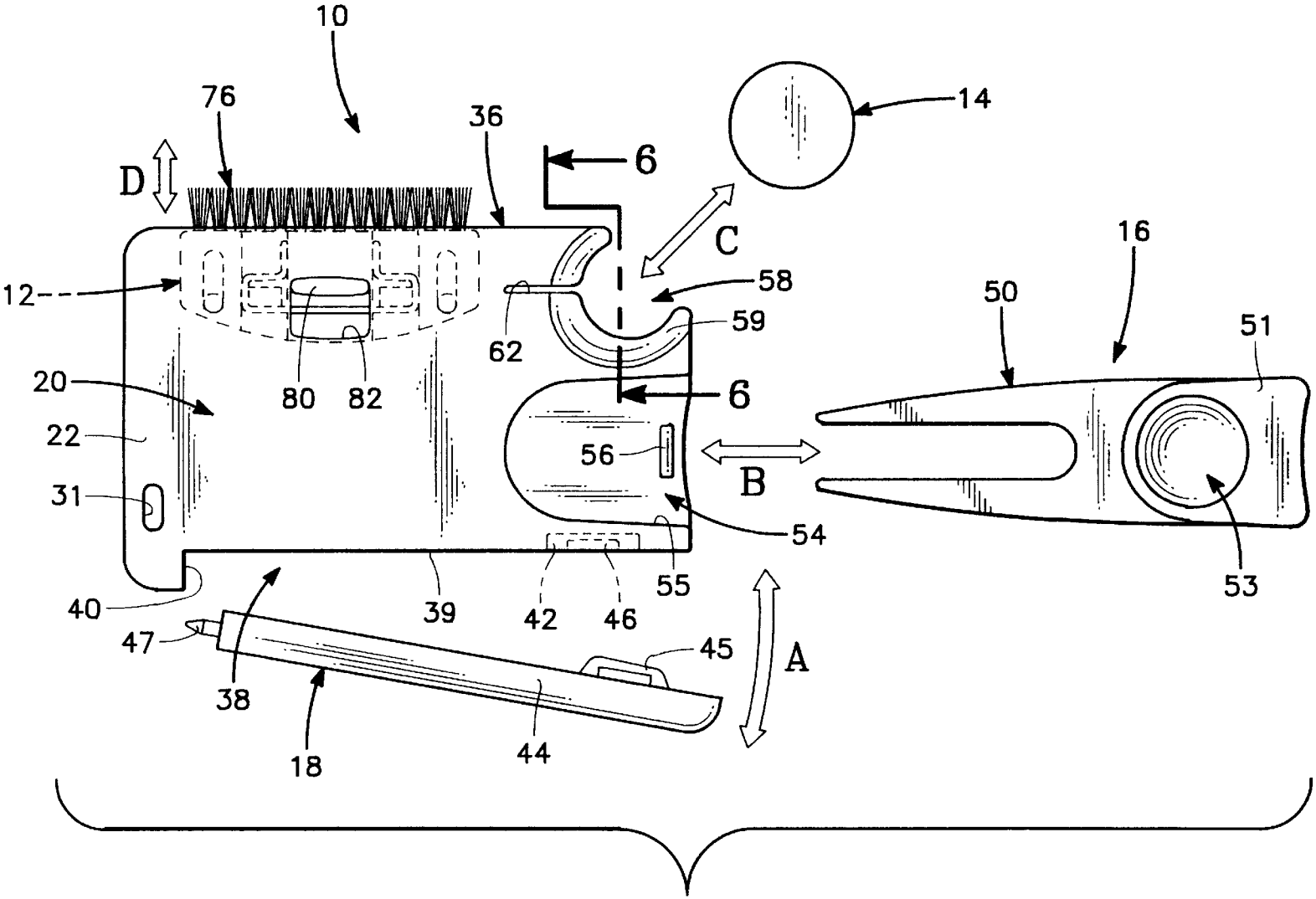
FIG. 5 is a front elevational view of the tool shown in FIG. 1 with the brush in an operative position and golfing implements exploded from the housing.
Figure 7:
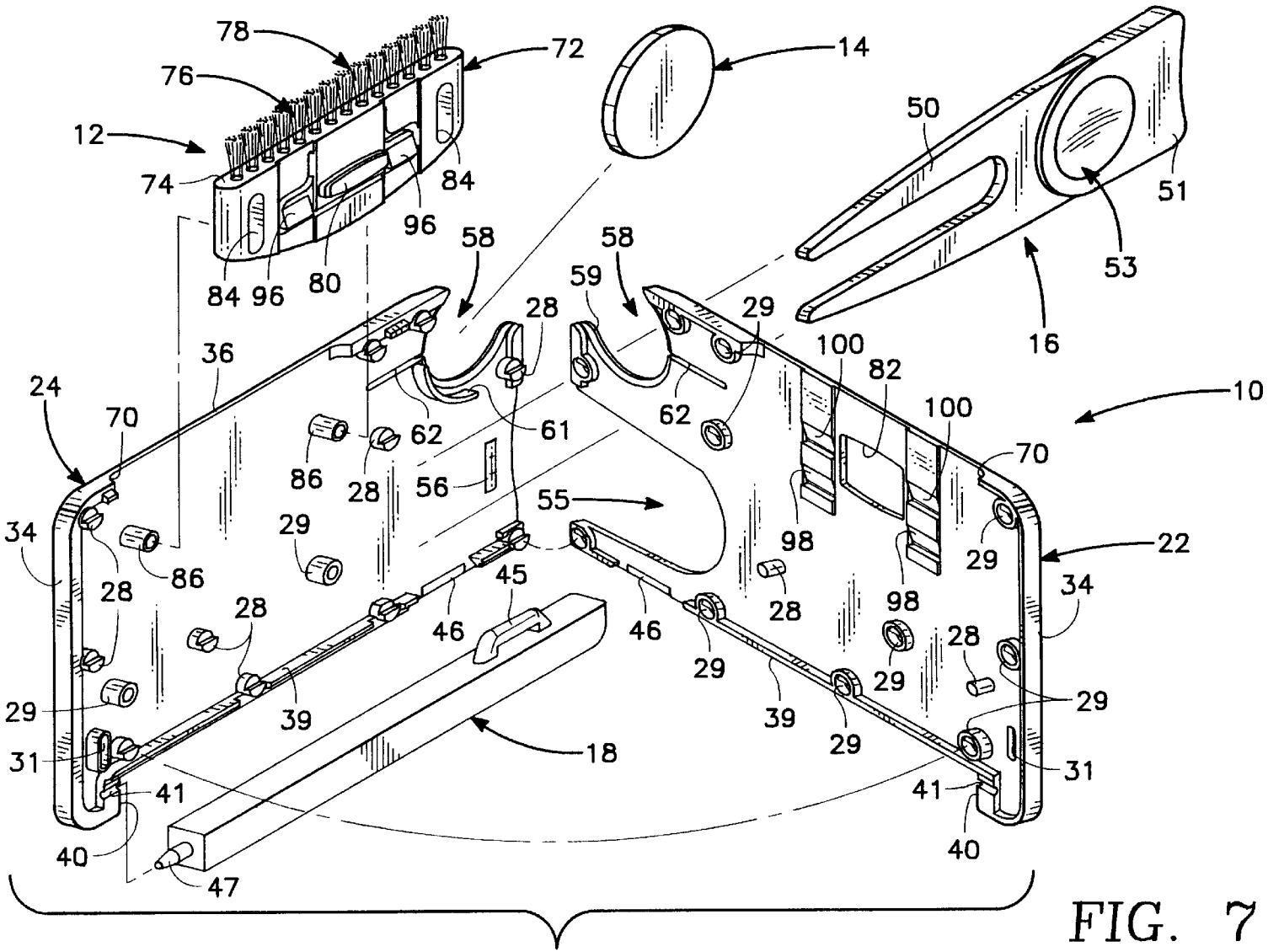
FIG. 7 is an exploded perspective view of the tool shown in FIG. 1.

With particular attention to FIGS. 1, 5 and 7 of the drawings, the overall multi-purpose tool assembly is shown by reference 10. The assembly comprises a housing 20 formed by the engagement of a front wall 22 and back wall 24. The walls are spaced-apart to provide an open interior 26 and are secured together by the friction engagement of pegs 28 and corresponding stub parts 29 in a manner known in the art. To at least partially enclose the housing interior, corresponding edge wall segments 34 are provided that extend along predetermined sections of the housing periphery.

Although a flat-walled card-shaped housing is illustrated having a rectangular outline, the housing could have a circular or oval shape. The housing is preferably constructed of a resilient plastic material having structural integrity. However, it could be constructed out of composite resin materials, metal, wood or impregnated fabric and paper materials. In addition to the implements disclosed herein, it is expected that the housing could incorporate a variety of accessory items such as a compass, clock, thermometer, calculator, mirror and illumination devices.

The bottom periphery of the housing is provided with an elongated inset region 38. The inset region is configured to correspond with the outline of pen 18. In this way, when the pen is secured within the inset region, the overall profile of the housing will not be materially altered.

Figure 10:
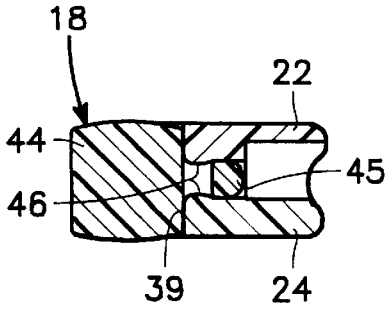
FIG. 10 is an enlarged fragmentary cross-sectional view taken along line 10 of FIG. 1.
Figure 11:
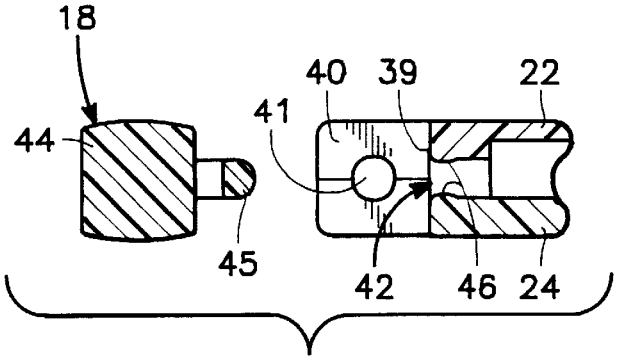
FIG. 11 is an enlarged fragmentary cross-sectional view similar to FIG. 10 showing a pen exploded from the housing.

With reference to FIGS. 5, 10 and 11, the pen comprises a casing 44 having a width coextensive with the housing thickness and a length about equal to the longitudinal extent of the inset region. It includes a pen point 47 at one end and a housing engagement handle 45 proximate the opposing end.

The inset region is defined by the matching engagement of longitudinal inset walls 39 of the respective front and back housing walls. When the walls are brought together, they form the overall inset structure along the bottom of the housing.

As shown, the inset region extends from an end of the housing along a major portion of the bottom periphery and terminates at an inwardly facing abstract wall 40. For securing the pen point during storage, the abutment wall is provided with a pen aperture 41.

Proximate the opposite end of the inset region is handle slot 42. The slot comprises notched portions of inset walls 39. Opposing sides of the notched portions are provided with friction bumps 46. The open space between the bumps is slightly less than the width of engagement handle 45.

To releasably secure the pen in the inset region, the pen point is inserted into aperture 41. Thereafter, the pen casing is rotated upwardly as depicted by arrow A in FIG. 5. When the engagement handle enters handle slot 42, the pen casing is pushed to force the handle past the friction bumps. A frictional engagement results as shown in FIG. 10.

As used herein, the word "pen" is intended to embrace all types of manual writing or marking instruments. Examples of such instruments suitable for use with the invention are ballpoint pens, felt-tipped pens, wood pencils, scribers and mechanical pencils.

As best illustrated in FIGS. 5, 7, 8 and 9, the housing includes an elongated implement shown as divot tool 16. The divot tool comprises a divot blade 50 and an end cover 51. The blade and cover are generally thin and flat in correspondence with the character of the housing. The cover overlies the blade head portion and includes a shallow finger recess 53 on its front side. On the cover backside is a transversely extending friction groove 52.

To accommodate the divot tool, the housing is provided with a tool opening 54 which is formed by a cut-out area 55 in front wall 22. The cut-out area extends inwardly from a side edge wall segment of the front wall. It has a configuration that corresponds to the planar outline of end cover 51. Matching the cut-out configuration with the shape of the end cover creates an integrated appearance and provides a constraint against unwanted movement of the divot tool.

Figure 8:
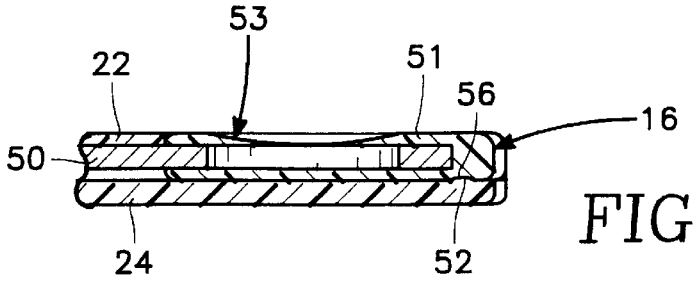
FIG. 8 is an enlarged cross-sectional fragmentary view taken along lines 8—8 of FIG. 1.
Figure 9:
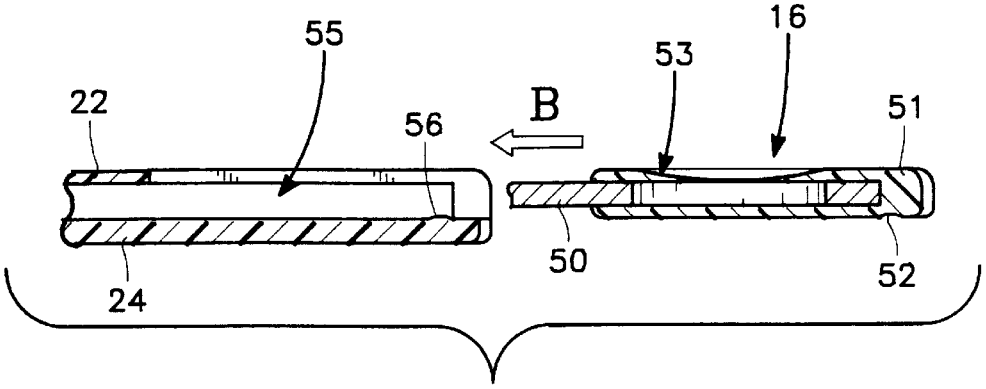
FIG. 9 is an enlarged cross-sectional fragmentary view similar to FIG. 8 depicting the divot tool exploded from the housing.

To further constrain and secure the divot tool within the housing interior, an abbreviated protuberance 56 is formed on the interior face of back wall 24. As depicted by arrow B in FIGS. 5 and 9, the divot tool is moved through the tool opening until the cover abuts against the back end of cut-out 55. In this position, the protuberance 56 and friction groove 52 will become engaged. This connection is shown in FIG. 8 and functions to resist dislodgement of the tool while in its storage position.

As best shown in FIGS. 1, 5 and 7, a corner of the housing is provided with a recess 58 to accommodate releasable engagement with a conventional disc-shaped golf ball marker 14. Although other locations on the housing periphery would be acceptable, engaging the ball marker at the corner of a rectangular housing creates a more aesthetically pleasing appearance and also facilitates insertion and removal of the marker.

The recess comprises curved cut-out portions of corresponding corners of the front and back walls of the housing. The space between the portions comprise an arcuate engagement opening 60 defined by cut-out edges 59. The cut-out edges are beveled to enhance frictional engagement with the disc which will slide therebetween as depicted by arrow C in FIG. 5.

To prevent the disc from moving too far into the engagement opening, a curved partition 61 is positioned at a predetermined offset from the back part of the opening. To permit a strong snap-in engagement and accommodate slight differences in disc diameters, an expansion slot 62 is provided extending inwardly an effective distance from the cut-out portion of each housing wall.

The top edge wall segment 36 of the housing periphery is provided with an elongated brush slot 70. The slot extends along about half the housing length. It is open to the housing interior and provides access to brush 12.

The brush comprises a base 72 having an outer edge 74 from which bristles 76 extend. Overall, the base is sufficiently thin to be enclosed within the housing interior. It has a length less than the longitudinal extent of the slot. A row of bristles extend outwardly about parallel with the overall plane of the base. As shown, the individual bristles are gathered into tufts and extend from the outer edge 74 a predetermined distance to a free end 78.

The length of the bristles somewhat dictate the span of movement of the brush. The span is the distance between a retracted storage position within the housing interior to an outer operative position wherein at least the longitudinal extent of the bristles are exposed in order to properly effect their function.

It will be appreciated that the invention comprehends the removal and use of the brush entirely from the housing. In this case, only the aforesaid holding means would be used to releasably engage the brush to the housing. However, this alternative is not preferred. Therefore, the description herein is directed to maintaining a permanent connection between the brush and the housing.

Movement of the brush is accomplished manually by manipulation of an upraised rib 80 extending from the base into an actuation opening 82 formed in the front wall 22 of the housing. The opening has sufficient length in the direction of movement of the brush to permit the above-described span of movement between the brush positions.

The width of the actuation opening may conveniently correspond with the length of the rib which, as shown, comprises an elongated protuberance having a longitudinal axis perpendicular to the direction of movement of the brush. Having the length of the rib slightly less than the width of the actuation opening will facilitate aligned movement of the brush.

To further enhance aligned movement and to help prevent the brush from being entirely withdrawn from the housing, a constraining means is provided. The constraining means comprises the combination of at least one guide opening in the base that interacts with a corresponding guide post extending across the housing interior into the guide opening.

As best shown in FIGS. 12–15, the base has opposing end sections through which extend a respective guide opening 84. Each guide opening is elongated with its longitudinal axis being parallel to the direction of movement of the brush. Extending into each guide opening is a respective guide post 86. The guide posts are located on the inner face of back wall 24 a predetermined distance from top edge wall 36. This distance, when taken in conjunction with the longitudinal extent of the guide openings, will permit the requisite brush movement to locate bristles 76 beyond the slot opening as shown in FIG. 5.

Preferably, a holding means is provided to releasably secure the brush in the desired retracted and operative positions. The holding means comprises the combination of a deflectable web portion in the base having at least one wedge part that is engageable with a corresponding detent structure in the housing. In particular, the base is provided with a base opening 92. The base opening comprises a cut-out area in the middle region of the base between guide openings 84. The area defines a bilaterally symmetrical configuration that conforms to the outline of web portion 90.

The web portion extends into the base opening from a center upper region of the base proximate outer end 74. The web portion is thinner than the base and a hinge groove 95 delineates the transition from the base into the web portion. The groove also functions as a living hinge to facilitate deflection of the web portion in a manner described below.

The main body area of the web portion that extends from groove 95 is referenced as midsection 94. Extending outward from each lower side edge of the midsection is a wedge part 96. The wedge parts are preferably mirror images of each other. They include inclined surfaces that terminate at a thickened abutment edge.

The wedge parts engage similarly shaped recessed areas formed in the inner face of housing wall 22. The recessed areas are delineated as lower detent structures 98 and upper detent structures 100. The lower detent structures 98 correspond to the retracted position of the brush and the upper detent structures 100 correspond to the operative position of the brush. The upper detent structures are aligned directly above the lower detent structures a distance equal to the span between the aforementioned operative and retracted positions of the brush.

Figure 12:
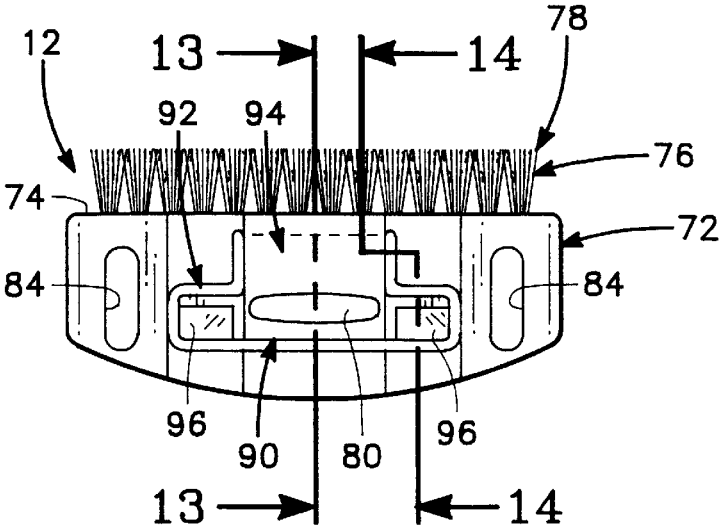
FIG. 12 is an enlarged front elevational view of the brush shown in FIG. 1.
Figure 13:
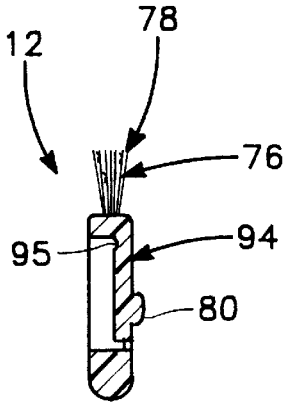
FIG. 13 is a cross-sectional view taken along lines 13—13 of FIG. 12.
Figure 15:
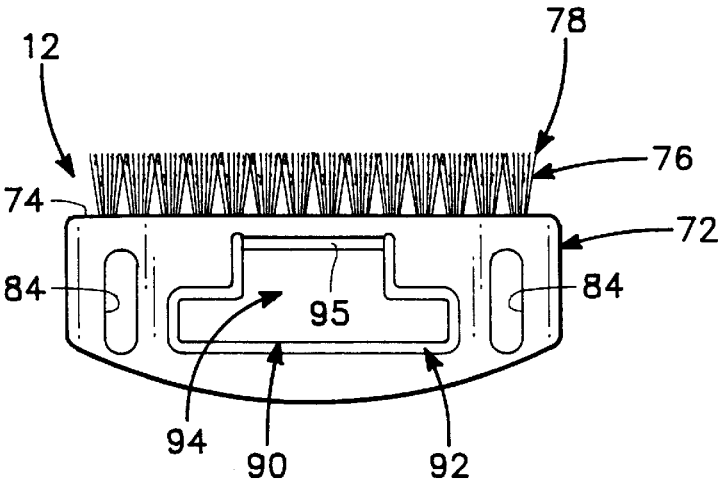
FIG. 15 is an enlarged back elevational view of the brush shown in FIG. 12.
Figure 14:
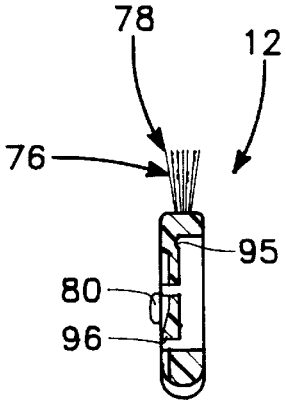
FIG. 14 is a cross-sectional view taken along lines 14—14 of FIG. 12.
Figure 17:
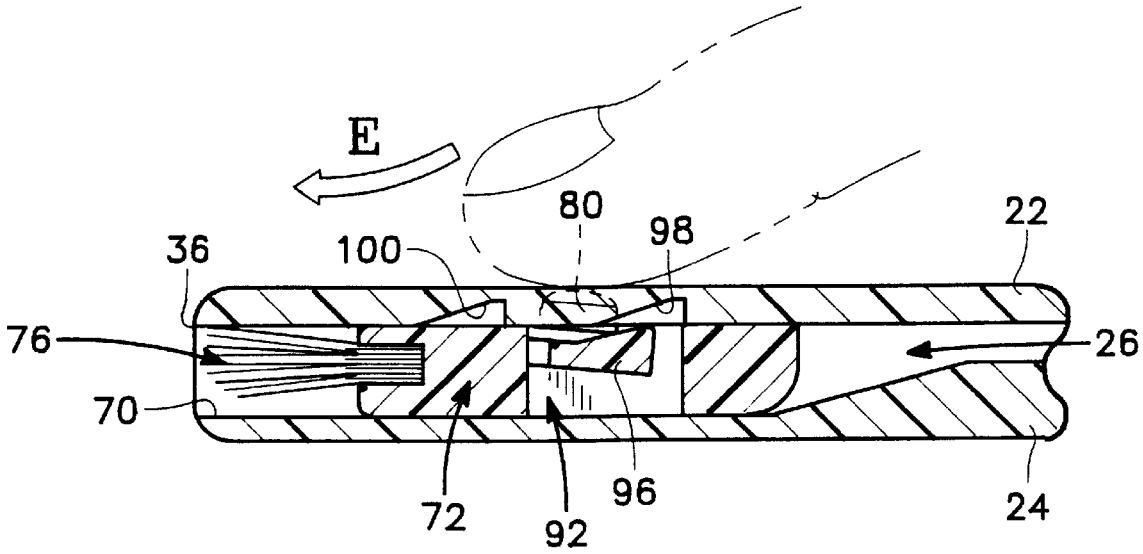
FIG. 17 is an enlarged fragmentary cross-sectional view similar to FIG. 16 showing the brush web portion and wedge parts being depressed while moving the brush to an operative position.
Figure 18:
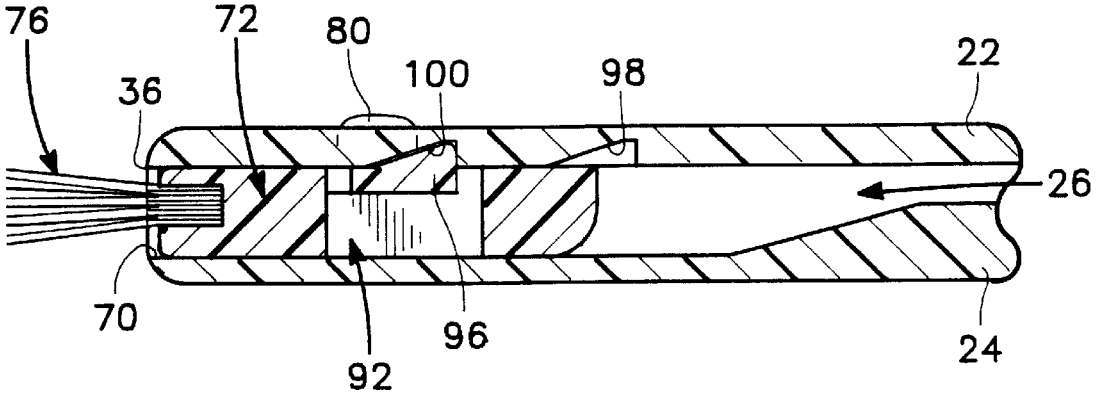
FIG. 18 is an enlarged fragmentary cross-sectional view similar to FIG. 16 showing the brush in an operative position.

As shown in FIGS. 12–14, rib 80 extends outwardly from midsection 94. Therefore, a user can depress the web portion by pressing against the rib to release the wedge parts from engagement with the detent structures. As depicted in FIG. 17, downward and forward pressure against the rib in the direction of arrow E will result in disengagement from lower detent structures 98 and outward movement of the brush. Outward movement will stop when either the guide posts engage the lower-most part of the guide openings or the rib engages the upper-most edge of actuation opening 82. This outward location corresponds to the brush operative position. Subsequently, the user can release pressure against the rib and allow the wedge parts to engage corresponding upper detent structures 100 as shown in FIG. 18. As so engaged, the brush may be utilized in a conventional manner whereby the housing functions as the brush handle. This attribute greatly enhances grasping and manipulation of the brush.

Figure 16:
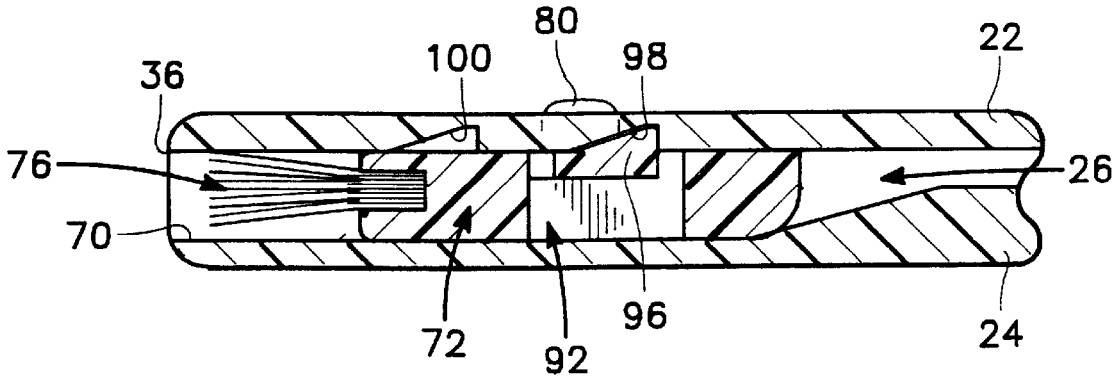
FIG. 16 is an enlarged fragmentary cross-sectional view taken along lines 16—16 of FIG. 1 showing the brush in a retracted position.

When work with the brush is completed, the web portion 80 is again depressed and the brush movement is reversed. This action will return the brush to the retracted position shown in FIG. 16.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiments, but only by the scope of the appended claims.

I claim:

1. A multipurpose tool assembly comprising:

a housing having an interior and a defined periphery;

at least one tool releasably engaged to said housing;

a slot extending from said periphery in to said interior;

a brush having a base and bristles mounted within said slot having actuation means for moving at least said bristles out of said slot; and, said housing including constraining means for guiding movement of said brush comprising at least one guide opening extending through said base and at least one post extending from said housing in to said guide opening.

2. The assembly of claim 1 wherein said housing has an actuation opening and said base includes a rib accessible through said actuation opening.

3. The assembly of claim 1 including a holding means for releasably connecting said brush to said housing.

4. The assembly of claim 3 wherein said housing periphery has a tool opening in communication with said interior, said assembly including an implement extending into said tool opening and interior.

5. The assembly of claim 3 wherein said housing periphery has an inset portion, said assembly including a writing instrument releasably engaged to said housing within said inset portion.

6. The assembly of claim 3 wherein said housing periphery includes a recess, said assembly including a disc-shaped object releasably engaged to said housing at said recess.

7. The assembly of claim 3 wherein said holding means comprises at least one detent structure in said housing and at least one deflectable wedge part in said base engageable with said detent structure.

8. The assembly of claim 7 wherein said base includes a deflectable web portion from which extends said rib and said wedge part.

9. The assembly of claim 1 wherein said bristles extend from said base a predetermined distance and said guide opening has a length at least about equal to said predetermined distance in a direction coextensive with the movement of said brush.

10. A multi-purpose golf tool assembly comprising:

a card-shaped housing having an outer periphery with spaced-apart front and back walls defining an interior, said periphery having a slot in communication said interior;

a brush having a base located in said interior which is movable relative to said slot;

at least one elongated guide opening extending through said base with the longitudinal axis of said guide opening being aligned in a direction about parallel with the direction of movement of said brush; and, at least one post extending from a predetermined location within said housing into a respective guide opening.

11. The assembly of claim 10 wherein said brush includes a base and said front wall includes an actuation opening, said base having a rib extending into said actuation opening.

12. The assembly of claim 11 wherein said base includes a deflectable web portion and said rib extends from said web portion.

13. The assembly of claim 12 wherein said front wall has at least one detent structure and said web portion has a corresponding wedge part for releasable engagement with said detent structure.

14. The assembly of claim 10 wherein said periphery includes a tool opening and said assembly includes a golf implement extending into said tool opening.

15. The assembly of claim 10 wherein said periphery includes a recess and said assembly includes a disc-shaped golf ball marker releasably fitted into said recess.

16. The assembly of claim 10 wherein said periphery includes an inset portion and said assembly includes a pen releasably fitted within said inset portion.

17. In a housing having an interior and a predetermined outline defined by an outer periphery, wherein the improvement comprises a slot in said periphery in communication with said interior and a brush with bristles located in said interior which is movable relative to said slot between a retracted position and an operative position, said brush including a base through which at least one elongated guide opening extends and said interior including at least one guide post extending into said guide opening.

18. The housing of claim 17 wherein said periphery includes a tool opening and said housing includes an implement extending into said tool opening.

19. The housing of claim 17 wherein said periphery includes an arcuate opening and said housing includes a disc-shaped object releasably attached to said arcuate opening.

20. The housing of claim 17 wherein said periphery includes an inset region and said housing includes a writing instrument releasably fitted into said inset portion.

21. The housing of claim 17 wherein the longitudinal axis of said guide opening is parallel with the direction of movement of said brush.

22. The housing of claim 21 wherein the longitudinal extent of said guide opening provides a constraint on the movement span of said brush.

23. The housing of claim 17 wherein said housing has an actuation opening and said brush includes a base having a rib that is accessible through said actuation opening to permit manual engagement with said rib.

24. The housing of claim 23 wherein said actuation opening has a predetermined width and said rib has a corresponding length that is less than said predetermined width.

25. The housing of claim 23 wherein said actuation opening has a predetermined length which is parallel to the direction of brush movement and is about equal to the span between said retracted position and said operative position.

26. The housing of claim 23 wherein said base includes a deflectable web portion and said rib extends from said web portion.

27. The housing of claim 26 wherein said interior includes at least one detent structure and said web portion includes a corresponding wedge part for releasable engagement with said detent structure.

28. The housing of claim 27 wherein said interior includes at least two detent structures spaced-apart in the direction of movement of said brush a distance about equal to the span between said retracted position and said operative position.

29. In a card-shaped housing having an interior and a predetermined outline defined by an outer periphery wherein the improvement comprises a slot in said periphery in communication with said interior and a brush with bristles located in said interior which is movable relative to said slot between a retracted position and a operative position, said housing having an actuation opening and said brush including a base having a rib that is accessible through said actuation opening, said base including a deflectable web portion and said rib extending from said web portion, said interior having at least one detent structure and said web portion including a corresponding wedge part for releasable engagement with said detent structure.

* * * * *